US007025073B2

(12) United States Patent
Holub

(10) Patent No.: US 7,025,073 B2
(45) Date of Patent: Apr. 11, 2006

(54) RING AND POLE CONNECTOR ASSEMBLY FOR A TENT CORNER

(75) Inventor: Timothy M. Holub, Cheney, KS (US)

(73) Assignee: The Coleman Company, Inc., Wichita, KS (US)

( * ) Notice: Subject to any disclaimer, the term of this patent is extended or adjusted under 35 U.S.C. 154(b) by 55 days.

(21) Appl. No.: 10/780,457

(22) Filed: Feb. 17, 2004

(65) Prior Publication Data

US 2005/0178418 A1 Aug. 18, 2005

(51) Int. Cl.
*E04H 15/62* (2006.01)
*E04H 15/64* (2006.01)

(52) U.S. Cl. ..... 135/119; 135/120.3

(58) Field of Classification Search ..... 135/119, 135/120.3

See application file for complete search history.

(56) References Cited

U.S. PATENT DOCUMENTS 960,849 A * 6/1910 Dilg ..... 135/120.4
3,223,098 A * 12/1965 Dole, Jr. ..... 135/126
4,078,572 A 3/1978 Moss et al.
4,195,651 A * 4/1980 Watts et al. ..... 135/135
4,352,362 A * 10/1982 Nichols ..... 135/98
4,665,935 A * 5/1987 Nichols ..... 135/125
5,315,736 A * 5/1994 Nilsson ..... 24/115 K
5,404,896 A * 4/1995 Howe ..... 135/125
5,628,336 A * 5/1997 Lee ..... 135/114
5,901,726 A * 5/1999 Gal et al. ..... 135/120.3
6,021,795 A * 2/2000 Long et al. ..... 135/98
6,776,179 B1 * 8/2004 Chen ..... 135/147

FOREIGN PATENT DOCUMENTS

EP 1158119 A1 11/2001

OTHER PUBLICATIONS

Copy of International Search Report by the EPO in corresponding foreign application (Jun. 27, 2005).

* cited by examiner

*Primary Examiner*—Robert Canfield
(74) *Attorney, Agent, or Firm*—Leydig, Voit & Mayer, Ltd.

(57) ABSTRACT

A ring and connector assembly for a tent. The ring and connector assembly is configured so that the connector attaches to the ring, such as via a loop that is attached to the connector and that extends around a portion of the ring. The ring is attached to the tent, for example at a floor edge of the tent, or at a corner of the tent. The connector is configured to be attached to a pole and may, for example, be a pin.

7 Claims, 2 Drawing Sheets

RING AND POLE CONNECTOR ASSEMBLY FOR A TENT CORNER

TECHNICAL FIELD OF THE INVENTION

The present invention relates generally to tents, and more particularly to tent construction.

BACKGROUND OF THE INVENTION

Tents are portable shelters made of lightweight, often waterproof, fabrics. Typically, a tent is a collapsible shelter of canvas or other material stretched over and sustained by a frame. Tents are used for camping outdoors or as temporary structures. Tents come in a variety of shapes and sizes. The most popular shape is the dome, or free standing, model. This model is easy to set up and does not require support from tree limbs or other objects.

Most contemporary backpacking tents are free standing, meaning that, when the tent is set up, the entirety of the pole structure for the tent is attached to the tent. This feature permits the erected tent to be lifted by one or more campers, without the tent losing its shape. A rain fly may extend over the pole structure of the tent, and may be attached to the tent or may be staked to the ground. The campers may also stake the tent itself to the ground.

For many free standing tent structures, long poles are used that are flexible and that are extended between opposite corners of the tent. These poles are bent into arcs so that the ends can be attached to the tent corners or elsewhere along the outside edges of the floor of the tent. The fabric of the tent is attached along the arcs, such as by loops, hooks, or sleeves. The ends of the poles that are attached to the corners of the tent (or alternatively are attached at the edges of the floor of the tent), coupled with the attachment of the walls and the roof of the tent to the central portion of the poles puts the tent fabric in tension, causing the tent fabric to take structure. After all of the poles are put in place, the tent fabric is tensioned to form the free standing tent structure.

Although the free standing tents work well for their intended purpose, the attachment of the poles to such structures have had associated problems. Particularly, the poles are often attached to a ring that may have additional functions, such as permitting attachment of tent stakes and/or a rain fly for the tent. The tension in the poles often locks the ring in place, and limits the flexibility, and therefore the use, of such a ring. In addition, the pole end may extend across the ring, and therefore may block some uses of the ring.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment of the invention, a ring and connector assembly is provided for a tent. The ring and connector assembly is configured so that the connector attaches to the ring, such as via a loop that is attached to the connector and that extends around a portion of the ring. The ring is attached to the tent, for example at a floor edge of the tent, or at a corner of the tent. The connector is configured to be attached to a pole and may, for example, be a pin.

In accordance with an embodiment of the invention, the connector is attached to a connecting structure (e.g., a webbing loop) that is used to connect the ring to the tent. For example, if a webbing loop is used to attach the ring to the floor edge, then the webbing loop may have a split into which the connector may be seated. By fixing the connector's position to the connecting structure for the ring, the remainder of the ring is free to rotate relative to the connecting structure and the connector. In this manner, a stake, such as a tent stake, may be attached to the ring with little effort. In addition, other items may be connected to the ring, such as a hook for attaching a rain fly of the tent.

The ring and connector assembly may be utilized in structures other than tents, but has particular relevance to attachment of a pin to a ring at a corner of a tent, or as otherwise located at a floor edge of a tent.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
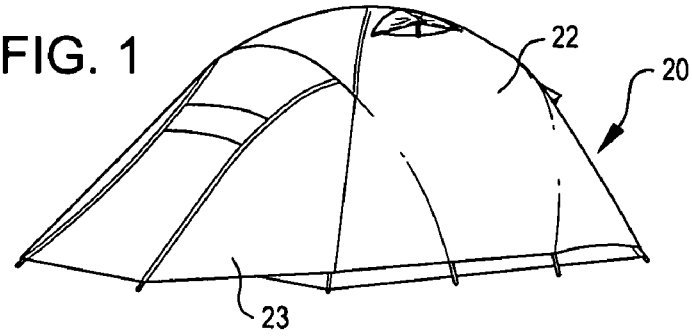
FIG. 1 is a side perspective view of a tent incorporating an embodiment of the invention.
Figure 2:
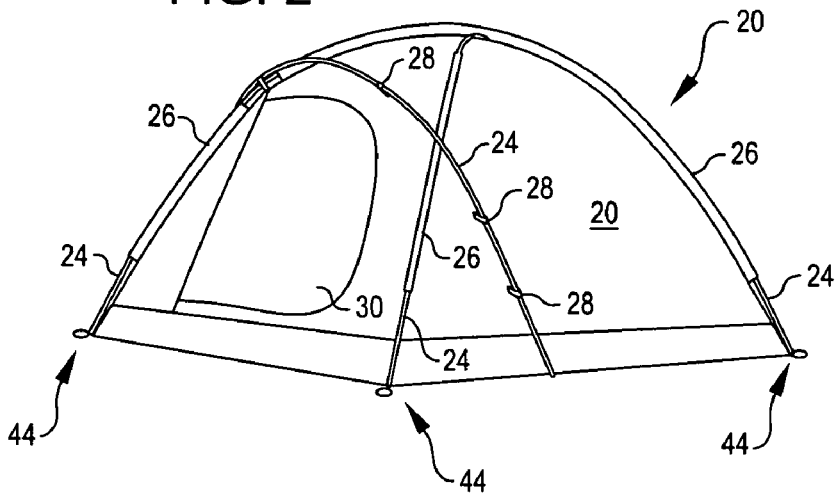
FIG. 2 is a side perspective view of the tent of FIG. 1, with a rain fly for the tent removed.

Referring now to the drawings, in which like reference numerals represent like parts throughout the several views, FIG. 1 shows a tent 20 incorporating an embodiment of the invention. The tent 20 includes a rain fly 22 having a vestibule 23 extending out a front side. FIG. 2 shows the tent 20 with the rain fly 22 removed.

The tent 20 shown in the drawings is a free standing model. The tent 20 may also be considered a "dome" style tent, although features of the invention may be used in different models of tents, whether free standing or not. Thus, although described with reference to the tent 20, the invention may be utilized with many different tent structures and, as further described below, could be used in structures other than tents.

The tent 20 includes poles 24 for supporting the tent 20 in an upright, assembled configuration. The tent 20 includes three poles 24. Two of the poles 24 extend between opposite diagonal corners 44 through sleeves 26 that extend along edges of sidewalls for the tent. In accordance with a manner known in the art, these poles 24 are typically straight. When the poles are installed, they are extended through the sleeves 26 and are bent into arcs and are attached at the corners 44 of the tent 20. The tension in the poles 24 places upward tension on the sleeves 26 and outward tension on the corners 44. The sleeves 26 cause the tension in the poles 24 to drive the ends of the poles 24 into to the corners 44, forcing the corners downward. The combined tension puts the tent walls and the tent floor in tension, which is counteracted by the inflexible nature of the tent walls. That is, the walls of the tent 20 are forced outward into the assembled position shown in FIG. 2. In addition, the tension in the poles 24 presses the corners 44 outward, causes the floor of the tent 20 to be placed under slight tension, removing wrinkles and maximizing floor space within the tent 20. Thus, the connection of the poles 24 provides stability for the tent 20 when the tent 20 is assembled. The poles 24 connect directly to the tent 20, and the tent may be lifted while maintaining the structure shown in the drawing. The tent is thus called "free standing," in that it does not need to be attached to the ground or to another structure for stability.

As stated above, a tent using such a pole system is known in the art. However, an embodiment of the present invention is directed to a new structure for connection of the poles 24 to the corners 44 or at other places along floor edges of a tent such as the tent 20.

The tent 20 includes an additional pole 24 that extends across the front of the tent 20 and which is attached to sidewalls of the tent by hooks 28. This additional pole 24 adds greater, improved stability to the tent 20, and may not be used for conventional dome tents. However, the additional pole 24 serves as an example of a pole that supports a tent (i.e., the tent 20) and which is not connected to corners (i.e., the corners 44) of the tent. More than one additional pole 24 may be provided as desired. In addition, any of the poles 24 or poles on another tent structure incorporating the invention may be attached to the sidewalls by a number of different mechanisms, for example by hooks (e.g., the hooks 28), sleeves (e.g., the sleeves 26), loops (not shown), or other suitable devices.

Figure 3:
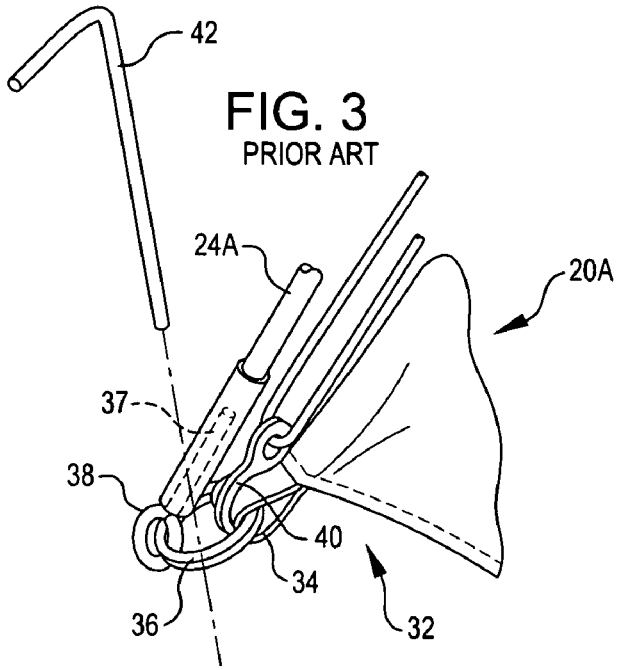
FIG. 3 PRIOR ART
FIG. 3 is a partial cut-away side perspective view of a corner of a prior art tent.

FIG. 3 shows a prior art method of attaching poles, such as the poles 24, to a corner 32 of a prior tent 20A. For purposes of this example, the prior art tent 20A is assumed to be same structure as the tent 20, with the exceptions of the structures provided at the corners 32 (prior art) and 44. To prevent confusion, the prior art tent is referred to by the reference numeral 20A and the poles described with this prior art tent 20A are referred to with the reference numeral 24A.

At the corner 32 of the prior art tent 20A, a webbing loop 34 is formed. A ring 36 extends through this webbing loop 34. A pin 37 having a loop 38 at its lower end is connected to an outer portion of the ring 36. Specifically, the loop 38 fits around the outer portion of the ring 36.

When assembling the prior art tent 20A, a user inserts a pole 24A through one diagonal set of sleeves (e.g., the sleeves 26) and inserts a pin 37 into a hollow end of the pole 24A at a corner 32. This process locks the pole 24A in place. The pole 24A is then pressed from the opposite, distal end, driving the pole 24A into the pin 37 and tensioning the pole 24A against the sleeve. When the pole 24A is suitably tensioned, the distal end of the pole 24A is similarly connected to a pin 37 on an opposite corner 32 of the tent 20A.

One problem with the structure shown FIG. 3 is that the tension in the pole 24A presses the outer portion of the ring 36 (i.e., the portion to which the loop 38 of the pin 37 is attached) outward. This force limits and sometimes prevents rotation of the ring 36 relative to the webbing loop 34. In addition, the insertion of the pin 37 into the bottom of the pole 24A may be difficult because of the dual hinging action of (1) the ring 36 relative to the webbing loop 34, and (2) the loop 38 relative to the ring 36.

The attachment of the pole 24A to the pin 37 and the resulting tension in the pole 24A essentially locks the ring 36 into position. This lack of movement in the ring 36 may make it difficult for attaching other structures to the ring 36. For example, for many prior art tents, such as the tent 20A, a stake 42 may be provided that extends through the ring 36 and stakes the tent 20A to the ground. The position of the pole 24A may block insertion of the stake 42. In addition, the inability of the ring 36 to rotate may make it difficult to insert the stake 42 at an ideal angle. Other items may be attached to the ring 36, such as a hook 40 for attaching a rain fly (e.g., the rain fly 22), and the attachment of these additional structures may be difficult because of the inflexibility of the ring 36 and the position of the pole 24A.

Figure 4:
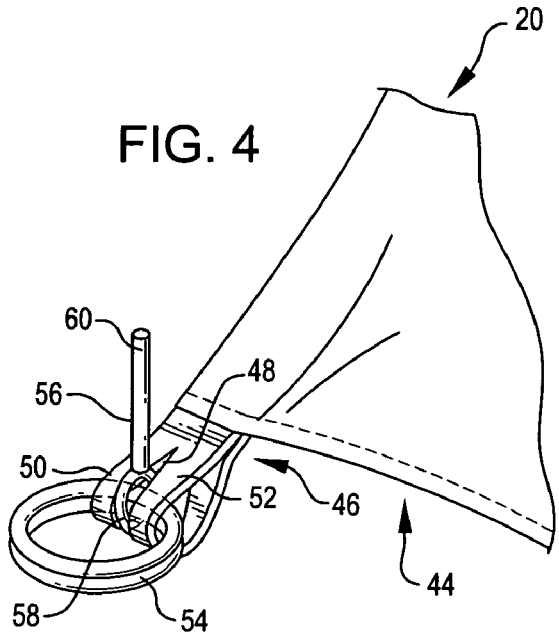
FIG. 4 is a partial cut-away view of a corner of the tent of FIG. 1 in accordance with an embodiment of the invention.

FIG. 4 shows a corner 44 of the tent 20 incorporating an assembly for attaching the poles 24 in accordance with an embodiment of the invention. The corner 44 includes a webbing loop 46 attached to the outer edge of the corner 44. In accordance with an embodiment of the invention, the webbing loop 46 includes a split 48 along a portion of its length. The split 48 causes the webbing loop 46 to divide into two sections 50, 52. Both sections 50, 52 of the webbing loop 46 fit around a ring 54.

Although described with reference to a webbing loop 46, another connecting structure may be used for attaching the ring 54 to the tent 20. For example, material other than webbing may be used for a loop, rope may be used to attach the ring 54 to the tent 20, or the ring 54 may be attached directly to the fabric of the tent corner 44. Other suitable connecting structures may be used for attachment of the ring 54 to the corner 44. In accordance with an embodiment, a connecting structure would allow rotation of the ring 54 about its connection to the tent 20, as indicated by the arrows A in FIG. 5, that is, in a direction transverse to a plane extending through the ring 54. Stated in another way, the outer portion of the ring 54 can pivot up and down relative to the portion of the ring connected to the tent 20 via the connecting structure.

A pin 56 having a hoop 58 at its base is attached to the ring 54 by the hoop 58. Specifically, the hoop 58 extends around the ring 54. In the embodiment shown in the drawings, the hoop 58 is positioned so that it extends between the two sections 50, 52 of the webbing loop 46. As such, the positions of the pin 56 and the hoop 58 are anchored by the webbing loop 46. By anchoring the pin 56 and the hoop 58 into their respective positions, connection of an end of the pole 24 over the pin 56 is made less difficult, because there are not two axes of rotation as exist in the prior art corner 32 described above with reference to FIG. 3.

Figure 5:
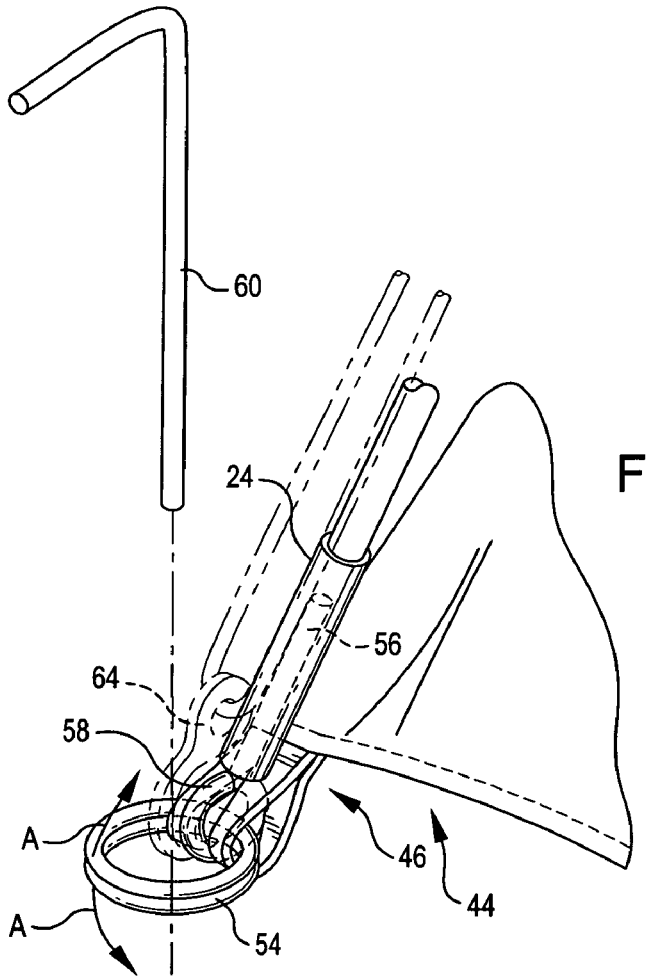
FIG. 5 is a partial cut-away side perspective view of the corner of FIG. 4, with additional features shown.

Moreover, once the pole 24 is attached to the pin 56, the ring 54 is free for rotation relative to the connecting structure in a direction transverse to a plane extending through the ring 54, for example for movement in the direction of the arrows A in FIG. 5. This freedom of movement permits easy installation of a stake 60 or a hook 64 similar to the stake 42 and hook 40 of FIG. 3. In addition, the ring 54 is readily available for use for other purposes, such as for attachment to a rope or to other structures.

Although the embodiment of the corner 44 described above includes attachment of a pole 24 to a pin 56, other structures, herein a "pole connector" or "connector," may be used to attach or otherwise connect the pole 24 to the ring 54. A hook and loop fastener, a lug, a snap, a fastener, a clip, a clasp, or another suitable connector may be utilized.

In accordance with an embodiment, the connector may be fixed to the ring 54, such as the pin 56 is attached to the ring 54. As examples, a connector may be attached to the ring 54 and may fit into a pole, such as the pole 24, in a manner similar to the way the pin 56 fits into the end of the pole 24, or alternatively may be reversed so that the connector fits around the pole 24. As another alternative, a connector may snap onto the pole 24 or the pole 24 may snap onto the connector. In addition, if desired, the pole connector may be included at the end of the pole 24 and may be configured and arranged for attachment to the ring 54 or the connecting structure.

In accordance with an embodiment, such a pole connector attaches so that it does not hinder rotation of the ring 54 in the directions depicted by the arrows A in FIG. 5. In accordance with another embodiment, a pole connector is positioned so that it connects to or is otherwise anchored by the connecting structure. In accordance with an embodiment, the pole connector is configured and arranged so that it substantially removes the connection of the pole 24 from the free portion of the ring 54 (i.e., away from the portion of the ring 54 not directly adjacent to the connecting structure).

In addition, although the ring 54 and pole connector (e.g., the pin 56) are shown connected to a corner 44 of the tent 20, the ring 54 and pole connector may be attached to another location on the tent 20, for example at a floor edge. One such location is shown by the distal ends of the front pole 24 of FIG. 2. Further, although the ring 54 and pole connector assembly are shown as being connected to a tent, the assembly may be used with other structures, including but not limited to tarpaulins and shelters.

With reference to the pin and hoop arrangement described above, although the hoop 58 is captured between the two sections 50, 52 of the webbing loop 46 in the embodiment shown, the pole connector (e.g., the pin 56) may anchored in another suitable way, e.g., captured by, attached to, or connected to the connecting structure for the ring 54 (e.g., the webbing loop 46). For example, the hoop 58 could be tied or otherwise connected to the webbing loop 46. In either event, in accordance with an embodiment of the invention, the pole connector is anchored to the connecting structure so that the pole connector does not move to the free end of the ring 54 after the pole 24 has been connected, although not all embodiments of the invention are necessarily formed in this manner.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tent, comprising:

webbing attached to the tent and having a split therein so as to form at least two sections of the webbing, each of the sections being attached to the tent;

a ring attached to the webbing; and a pin having a loop, the loop extending around the ring, the pin being configured to attach to a pole for the tent, and the pin being captured between the two sections.

2. The tent of claim 1, wherein the webbing is attached to a floor edge of the tent.

3. The tent of claim 1, wherein the webbing is attached to a tent corner.

4. A tent, comprising:

a ring attached to the tent by webbing that is connected at a portion of the ring, the ring defining a plane along the ring and an axis parallel to or in the plane, the webbing comprising at least two sections, both sections being attached to the tent; and a pole connector anchored to the ring between the two sections, the pole connector and the webbing being configured and arranged such that, when a pole is connected to the pole connector, the ring is free for rotation about the axis.

5. The tent of claim 4, wherein the pole connector is connected to the ring at the axis.

6. The tent of claim 5, wherein the pole connector comprises a pin.

7. The tent of claim 4, wherein the pole connector comprises a pin.

* * * * *